US009963820B2

(12) United States Patent
Fuchs et al.

(10) Patent No.: US 9,963,820 B2
(45) Date of Patent: May 8, 2018

(54) CELLULOSE FIBER AND PROCESS FOR THE PRODUCTION THEREOF

(75) Inventors: Heidrun Fuchs, Voecklabruck (AT); Peter Dobson, Borrowash (GB)

(73) Assignee: Lenzing Aktiengesellschaft, Lenzing (AT)

( * ) Notice: Subject to any disclaimer, the term of this patent is extended or adjusted under 35 U.S.C. 154(b) by 765 days.

(21) Appl. No.: 13/001,098

(22) PCT Filed: Jun. 18, 2009

(86) PCT No.: PCT/AT2009/000242

§ 371 (c)(1),
(2), (4) Date: Feb. 9, 2011

(87) PCT Pub. No.: WO2009/155624

PCT Pub. Date: Dec. 30, 2009

(65) Prior Publication Data

US 2011/0171865 A1 Jul. 14, 2011

(30) Foreign Application Priority Data

Jun. 27, 2008 (AT) ..... A 1030/2008

(51) Int. Cl.

| | |
|---|---|
| ***D03D 15/00*** | (2006.01) |
| ***D06M 13/358*** | (2006.01) |
| ***D06M 11/71*** | (2006.01) |
| ***D06M 11/76*** | (2006.01) |
| ***D06M 11/82*** | (2006.01) |
| ***D06M 13/184*** | (2006.01) |
| ***D06M 13/432*** | (2006.01) |
| *D06M 101/06* | (2006.01) |

(52) U.S. Cl.

CPC ..... *D06M 13/358* (2013.01); *D06M 11/71* (2013.01); *D06M 11/76* (2013.01); *D06M 11/82* (2013.01); *D06M 13/184* (2013.01); *D06M 13/432* (2013.01); *D06M 2101/06* (2013.01); *Y10T 428/2965* (2015.01); *Y10T 442/30* (2015.04); *Y10T 442/40* (2015.04)

(58) Field of Classification Search

CPC ..... D06M 11/71; D06M 11/76; D06M 11/82; D06M 13/184; D06M 13/358; D06M 13/432; D06M 2101/06; Y10T 428/2965; Y10T 442/30; Y10T 442/40

USPC ..... 442/165

See application file for complete search history.

(56) References Cited

U.S. PATENT DOCUMENTS

| | | | | |
|---|---|---|---|---|
| 4,246,221 A | | 1/1981 | McCorsley, III | 264/203 |
| 5,409,532 A | | 4/1995 | Astegger et al. | 106/200.2 |
| 5,589,125 A | | 12/1996 | Zikeli et al. | 264/187 |
| 5,662,858 A | * | 9/1997 | Firgo et al. | 264/474 |
| 5,968,434 A | | 10/1999 | Zikeli et al. | 264/187 |
| 6,022,378 A | | 2/2000 | Eibl | 8/190 |
| 6,241,933 B1 | | 6/2001 | Köll et al. | 264/340 |
| 6,495,058 B1 | * | 12/2002 | Frankenbach et al. | 252/8.91 |
| 6,645,409 B2 | | 11/2003 | Feilmair et al. | 264/145 |
| 2002/0008331 A1 | | 1/2002 | Feilmair et al. | 264/145 |

FOREIGN PATENT DOCUMENTS

| | | |
|---|---|---|
| AT | 413 287 B | 1/2006 |
| CH | 685 944 A5 | 11/1995 |
| EP | 0 538 977 A1 | 3/1992 |
| EP | 0 553 070 A1 | 7/1993 |
| EP | 0 755 467 B1 | 4/1995 |
| WO | 92/14871 | 9/1992 |
| WO | 93/19230 A1 | 9/1993 |
| WO | 94/09191 A1 | 4/1994 |

(Continued)

OTHER PUBLICATIONS

English-language translation of the International Preliminary Report on Patentability which includes the Written Opinion of the International Searching Authority issued in the International Application No. PCT/AT2009/000242—8 pages.

*Primary Examiner* — Elizabeth M Cole

(74) *Attorney, Agent, or Firm* — Fitzpatrick, Cella, Harper & Scinto

(57) ABSTRACT

The invention concerns a cellulose fiber of the genus Lyocell which is treated with a cross-linking agent, with the cross-linking agent inducing a protection from fibrillation on the fiber and exhibiting the following properties:

- the protection from fibrillation induced by the cross-linking agent changes if the fiber is stored within a pH range from 4.0 to 10.0, in particular under the influence of moisture and/or heat,
- within the pH range from 4.0 to 10.0, an optimum value exists at which the stability of the protection from fibrillation induced by the cross-linking agent during storage is highest
- a suitable range exists around the optimum value in which the stability is reduced by 20% at the most, compared to the stability at the optimum value,
- within the pH range from 4.0 to 10.0, the suitable range is limited by at least one limiting value at which the stability is reduced by 20% compared to the long-term stability at the optimum value and with a further decrease in stability occurring below and above said value, respectively, and
- the cross-linking agent has the capability to change the pH value.

The fiber according to the invention is characterized in that the fiber comprises a buffering substance in the suitable range and exhibits a buffer capacity of at least about 12 mmol/kg fiber, preferably from about 15 to about 70 mmol/kg fiber, in the suitable range.

17 Claims, No Drawings

(56) References Cited

FOREIGN PATENT DOCUMENTS

| | | | | |
|---|---|---|---|---|
| WO | 94/24343 | A1 | | 10/1994 |
| WO | 95/28516 | A1 | | 10/1995 |
| WO | 97/07267 | A1 | | 2/1997 |
| WO | WO 9707267 | A1 | * | 2/1997 |
| WO | 97/49856 | A1 | | 12/1997 |
| WO | 99/19555 | A1 | | 4/1999 |
| WO | 00/18991 | A1 | | 4/2000 |

* cited by examiner

CELLULOSE FIBER AND PROCESS FOR THE PRODUCTION THEREOF

This application is a 371 of PCT/AT2009/000242 filed Jun. 18, 2009.

BACKGROUND OF THE INVENTION

Field of the Invention

The invention concerns a cellulose fiber of the genus Lyocell as well as a process for the production thereof.

In recent decades intensive efforts have been undertaken to provide alternative, more ecologically friendly processes due to the environmental problems associated with the known viscose process for the production of cellulosic fibers. One particularly interesting possibility, which has emerged in recent years, is to dissolve cellulose in an organic solvent without the formation of a derivative and to extrude moulded bodies from this solution. Fibers spun from such solutions have been allocated the generic name Lyocell by BISFA (The International Bureau for the Standardization of Man Made Fibers), whereby an organic solvent is understood to be a mixture of an organic chemical and water.

Moreover, such fibers are also known by the term "solvent-spun fibers".

SUMMARY OF THE INVENTION

It has become apparent that in particular a mixture of a tertiary amine oxide and water is excellently suitable as the organic solvent for the production of Lyocell fibers and other moulded bodies, respectively. Mainly N-methyl-morpholine-N-oxide (NMMO) is thereby used as the amine oxide. Other suitable amine oxides are disclosed in EP-A 553 070. Processes for the production of cellulosic moulded bodies from a solution of cellulose in a mixture of NMMO and water are disclosed, e.g., in U.S. Pat. No. 4,246,221 or in WO 93/19230. In doing so, the cellulose solution is extruded from a spinneret, stretched in an air gap and precipitated from the solution in an aqueous precipitating bath. In the following, this process is referred to as the "amine-oxide process" or "Lyocell process", whereby, in the following, the abbreviation "NMMO" denotes all tertiary amine oxides which can dissolve cellulose. The processing of Lyocell fibers immediately after spinning is described, for example, in WO 92/14871 and WO 00/18991. Fibers produced according to the amine-oxide process are characterized by a high fiber tenacity in the conditioned and wet states, a high wet modulus and a high loop strength.

Furthermore, it is known that Lyocell fibers have a certain tendency toward fibrillation. Numerous measures against this property have already been suggested, wherein the treatment of a Lyocell fiber with a cross-linking agent constitutes a commercially significant approach.

Suitable cross-linking agents are described, for example, in EP 0 538 977, WO 97/49856 and WO 99/19555. Other cross-linking agents are known, e.g., from WO 94/09191 and WO 95/28516.

A particularly preferred cross-linking agent is a substance of formula CO (I)

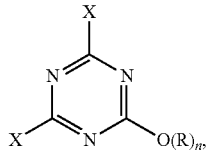

wherein X represents halogen, R=H or an ionic moiety and n=0 or 1, or a salt of said compound, respectively.

Lyocell fibers treated with such cross-linking agents are better protected against fibrillation than untreated Lyocell fibers. A measure for the protection from fibrillation is the wet abrasion resistance (NSF) of the fibers.

Nevertheless, however, problems due to pilling and fibrillation because of insufficient protection from fibrillation may occur in Lyocell fibers treated with cross-linking agents, in particular during their further processing into yarns and fabrics.

As has likewise been found, the protection from fibrillation decreases over time during storage. It is assumed that, in some cases, this is due to a slow, but continuous hydrolysis of the cross-linker bonds. The extent of this cross-linker hydrolysis and hence of the decrease in protection from fibrillation can thereby vary extensively, depending on how long and under which climatic conditions the cellulose fiber is stored.

It is the object of the present invention to provide a cellulose fiber of the genus Lyocell, wherein the protection from fibrillation produced by a treatment with a cross-linking agent is maintained for a longer period of time than with conventional Lyocell fibers.

Said object is achieved by a cellulose fiber of the genus Lyocell which is treated with a cross-linking agent, with the cross-linking agent inducing a protection from fibrillation on the fiber and exhibiting the following properties:

the protection from fibrillation induced by the cross-linking agent changes if the fiber is stored within a pH range from 4.0 to 10.0, in particular under the influence of moisture and/or heat within the pH range from 4.0 to 10.0, an optimum value exists at which the stability of the protection from fibrillation induced by the cross-linking agent during storage is highest a suitable range exists around the optimum value in which the stability is reduced by 20% at the most, compared to the stability at the optimum value within the pH range from 4.0 to 10.0, the suitable range is limited by at least one limiting value at which the stability is reduced by 20% compared to the long-term stability at the optimum value and with a further decrease in stability occurring below and above said value, respectively the cross-linking agent has the capability to change the pH value.

The fiber according to the invention is characterized in that the fiber contains a substance buffering in the suitable range and exhibits a buffer capacity of at least 12 mmol/kg fiber, preferably from 15 to 70 mmol/kg fiber, in the suitable range.

DETAILED DESCRIPTION OF THE INVENTION

For the purposes of the present invention:

"Protection from fibrillation" means that the fiber treated with the cross-linking agent has a higher resistance against fibrillation than an untreated fiber. This is established by the test regarding the wet abrasion resistance as described in WO 99/19555.

"The protection from fibrillation induced by the cross-linking agent changes if the fiber is stored within a pH range from 4.0 to 10.0" means that, when the fiber treated with the cross-linking agent is stored, a change occurs in the protection from fibrillation—e.g., caused by the influence of heat and moisture, in particular water vapour. This can be determined using a test as described below regarding the wet abrasion resistance of fibers stored over a certain period of time at different pH values which are kept constant under buffering. In doing so, the time span until the wet abrasion resistance has decreased by 30% compared to the initial value is in each case determined.

"Within the pH range from 4.0 to 10.0, an optimum value exists"—This is the case when, during storage of the fiber treated with the cross-linking agent, a decrease in the protection from fibrillation occurs in a certain pH range going from 4.0 to 10.00, said decrease being lower than with other pH values. Thus, in the pH range from 4.0 to 10.0, at least one pH value has to exist at which the stability of the protection from fibrillation induced by the cross-linking agent during storage is highest, i.e., at which the duration until the wet abrasion resistance has decreased by 30% compared to the initial value is longest. In the following, said value is referred as the "optimum value". Since a constant optimum of the stability of the protection from fibrillation can, in some cases, be observed across a certain pH range (e.g., a range from 0.5 to 1 pH units) instead of in only one point, the term "optimum value" comprises also such a pH range.

"A suitable range exists around the optimum value"—A range has to exist around the optimum value in which the stability is reduced in comparison to the stability at the optimum value. In the following, the range referred to as the "suitable range" is that in which the stability is reduced by 20% at the most, compared to the stability at the optimum value.

"Within the pH range from 4.0 to 10.0, the suitable range is limited by at least one limiting value"—this means that, at least toward one direction (i.e., toward acidic or toward alkaline pH values), the suitable range is limited by a pH value at which the duration until a 30% decrease in the wet abrasion resistance is reached has been shortened to 80% of the (maximum) duration at the "optimum value". In the following, said value is referred to as the "limiting value".

"The cross-linking agent has the capability to change the pH value"—this criterion means that the cross-linking agent itself affects the pH value of the fiber in the course of storage, e.g., as a result of the influence of moisture or heat and/or by reacting with the fiber, respectively—be it by cleaving off from the fiber or by continuing to react not-yet bound or free reactive groups, respectively. This is determined by observing the development of the fiber pH value of a fiber treated with the respective cross-linking agent (see further below).

The pH value of the fiber is established according to the method indicated further below.

The buffer capacity of a fiber is likewise established by a test as described further below.

For the purposes of the present invention, the term "contains" comprises also an attachment of the buffering substance on the surface of the fiber.

If a cross-linking agent meets the above-mentioned criteria, i.e., a) if the protection from fibrillation changes when the fiber treated with the cross-linking agent is stored within a pH range from 4.0 to 10.0, in particular under the influence of moisture and/or heat, b1) if, within the pH range from 4.0 to 10.0, an optimum value exists at which the stability of the protection from fibrillation induced by the cross-linking agent during storage is highest, b2) if a suitable range exists around the optimum value in which the stability is reduced by 20% at the most, compared to the stability at the optimum value, b3) if, within the pH range from 4.0 to 10.0, the suitable range is limited by at least one limiting value at which the stability is reduced by 20% compared to the long-term stability at the optimum value, and c) if the cross-linking agent has the capability to change the pH value, it has been shown that, by the addition of buffering substances which buffer in the specific pH range suitable for the respective cross-linking agent, the pH value of the fiber can be kept in said suitable range and hence a reduction in the protection from fibrillation in the course of storage can also be impeded.

As has been shown in extensive studies, the speed of the breakage of the cross-linker bonds as mentioned depends particularly on the following 3 parameters:

1) temperature
2) moisture
3) fiber pH

Whereas only little influence can be exerted on parameters 1) and 2) from the manufacturer's side, it has been shown that the pH value of the fiber can have a decisive impact on the speed of the cross-linker hydrolysis. It has been found that, depending on the cross-linking agents used, a pH range exists in which the cross-linking of Lyocell fibers has the greatest stability.

Depending on the process control, e.g., the type of finishings applied, cross-linked Lyocell fibers can indeed exhibit an initial pH value during manufacture which is in a range which, in each case, is ideal for the respective cross-linking agent used. However, it has now been found that, depending on the process control and the type of cross-linking agent used, the fibers may comprise a more or less large portion of partially reacted cross-linker molecules which contain, e.g., acid-forming moieties (e.g., chlorine moieties). Those reactive moieties can complete their reactions during further processing steps, e.g., in the drier, during remoistening, steaming, but also during storage. As a result, the pH value of the fiber will change. The shift of the pH value away from the optimum pH range will, in turn, lead to an acceleration of the cross-linker hydrolysis.

The present invention now starts out from this finding which has not been previously known by using a substance in the range ideal for the respective cross-linker which has a buffering effect in said pH range for maintaining the pH value of the fiber.

It is thereby achieved that the protection from fibrillation is maintained also if the fiber is stored over an extended period of time.

Preferably, the fiber according to the invention has a pH value in the suitable range.

Preferably, at least one of the buffering substances that are used also has a $pK_a$ value in the suitable range. However, substances which have a $pK_a$ value slightly outside the suitable range, e.g., in the range of, in each case, up to 1 pH unit, preferably up to 0.5 pH units, above or below the "limiting value", respectively, are also suitable, provided that the buffer effect goes toward those pH values at which a deterioration in the storage stability of the fibrillation behaviour occurs.

A cross-linking agent which meets the above criteria a) to c) and is used particularly preferably is a substance of formula (I)

(I)

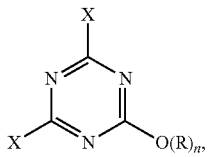

wherein X represents halogen, R=H or an ionic moiety and n=0 or 1, or a salt of said compound, respectively. The use of those cross-linking agents for the treatment of Lyocell fibers is known from WO 99/19555. The sodium salt of 2,4-dichloro-6-hydroxy-1.3.5-triazine is particularly preferred.

It has been shown that cross-linking agents of this group meet the above criterion a), i.e., the protection from fibrillation changes if the fiber treated with the cross-linking agent is stored within a pH range from 4.0 to 10.0, in particular under the influence of moisture and/or heat.

Furthermore, those cross-linking agents, in particular the sodium salt of 2,4-dichloro-6-hydroxy-1.3.5-triazine, have an "optimum value" (or, respectively, in this case an optimum range) at a pH value in the range from 9 to 9.5 (criterion b1)) in which the stability of the protection from fibrillation during storage is best. In addition, those cross-linking agents, in particular the sodium salt of 2,4-dichloro-6-hydroxy-1.3.5-triazine, have a "limiting value" (according to the above definition) at a pH value of 8.5 (criterion b2)). Below said limiting value, the protection from fibrillation decreases significantly faster than above said value, when the fiber is stored. Thus, a "suitable" range according to the above definition exists (criterion b3)). Moreover, the sodium salt of 2,4-dichloro-6-hydroxy-1.3.5-triazine has a further limiting value at a pH value of 10.5, above which limiting value the protection from fibrillation again decreases significantly faster during storage. However, a storage of cellulose fibers at pH values of more than 10.5 is not realistic so that the use of buffering substances is not necessary in this range.

Ultimately, cross-linking agents of this group also have the capability to change the pH value (criterion c), which is apparently due to the release and the further reaction, respectively, of the halogen groups contained.

Therefore, a fiber treated with this cross-linking agent should preferably have a pH value ranging from 8.5 to 10.5.

Advantageously, the buffering substances used in this preferred embodiment have a pKa value ranging from 8.0 to 11.0.

In particular substances from the group consisting of borax; carbonates or bicarbonates of alkali metal ions (e.g., Li, Na, K ions, ammonium or cations derived from substituted amines (e.g., mono, di, trimethyl ammonium or mono, di, triethyl ammonium); phosphates, hydrogen phosphates or dihydrogen phosphates of alkali metal ions, ammonium or cations derived from substituted amines; ammonia; substituted amines (e.g., mono, di, trimethyl amine or mono, di, triethyl amine); guanidine or guanidinium salts; and mixtures thereof as well as mixtures with carboxylic acids and salts thereof are suitable as buffering substances.

In particular borax ($Na_2B_4O_7 \times 10H_2O$) and the system hydrogen carbonate/carbonate as well as mixtures thereof as well as mixtures of borax and phosphate buffer are suitable as inorganic buffer systems. A mixture of carbonate and phosphate buffer is applicable as well. Particularly preferably, borax is used as the buffering substance.

Borax buffers in both pH directions and in this way also prevents fiber pH values which are partially too high by neutralizing possible regions having a higher alkali content.

The use of borax appears sensible particularly in the pH range from 8.8 to 9.7, wherein a pH value deviating from the pKa (=9.2-9.3) of borax can be adjusted by adding conventional acids or lyes.

Advantageously, however, a pH value around the pKa value is maintained. However, instead of using borax alone, borax can also be used together with other buffer systems (hydrogen carbonate/carbonate and/or phosphate buffer).

According to the invention, borax is added to the fiber in amounts of 0.05% to 1.4% borax, based on cellulose, preferably of 0.3-0.6%, wherein the application may occur together with the application of a finishing. Borax is preferably added as a solid via a solid dosing unit, since, in that case, the finishing does not have to be diluted. However, borax can also be added as an aqueous solution when the finishing is being prepared.

The concentration of borax in the fiber preferably amounts to at least 1525 mg borax per kg fiber. This is equivalent to a content of at least 173 mg/kg boron on fiber. Concentrations from 2860 mg to 14000 mg borax per kg fiber are particularly suitable. This is equivalent to a content of 324 to 1600 mg/kg boron on fiber.

The buffer system sodium hydrogen carbonate/sodium carbonate is also well suited as a buffering substance, namely particularly in concentrations of at least 848 mg per kg fiber (calculated as sodium carbonate). A concentration range from 1580 mg to 7420 mg per kg fiber (calculated as sodium carbonate) is particularly preferred.

Furthermore, the cellulose fiber according to the invention preferably exhibits a fiber moisture of 8-10%. With higher moisture contents, buffering as provided according to the invention is all the more important.

The invention also concerns a cellulose fiber of the genus Lyocell which is treated with a cross-linking agent of formula (I)

(I)

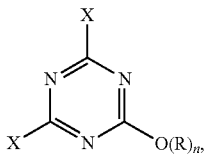

wherein X represents halogen, R=H or an ionic moiety and n=0 or 1, or a salt of said compound, respectively, preferably with the sodium salt of 2,4-dichloro-6-hydroxy-1.3.5-triazine, and is characterized in that the fiber contains a substance buffering against the action of acid in the pH range from 7.5 to 11.0, preferably from 8.5 to 10.5, and exhibits a buffer capacity of at least 12 mmol/kg fiber, preferably from 15 to 70 mmol/kg fiber, in said pH range.

Preferably, said embodiment of the cellulose fiber according to the invention contains the buffers which have already been concretely indicated above in the amounts indicated there.

A further aspect of the present invention concerns a bale of cellulose fibers which contains the Lyocell fibers according to the invention.

It is known that Lyocell fibers and also other man-made fibers are pressed into bales after their manufacture and are shipped to the purchasers (e.g., manufacturers of yarns) in this form. The storage of the fibers thus occurs in the form of bales both at the manufacturer's (prior to shipping) and at the purchaser's location (prior to further processing). For maintaining the protection from fibrillation during said storage it is therefore particularly suitable if the bale contains Lyocell fibers according to the invention which have been stabilized by the presence of a buffering substance. In particular, the bale can consist essentially completely of the fibers according to the invention. "Essentially" is understood to mean that minor admixtures of other fibers (e.g., marker fibers for better identification of the product) may be contained.

Textile articles such as yarns, woven fabrics, knitted fabrics, braided fabrics and hosieries are stored, too, whereby a reduction in the protection from fibrillation may occur. Accordingly, the present invention also concerns textile articles such as yarns, woven fabrics, knitted fabrics, braided fabrics and hosieries which contain the Lyocell fibers according to the invention. In particular, the invention concerns textile articles which have not yet been subjected to a wet process (e.g., reactive dyeing), since, in conventional wet processes of cellulosic fibers, in the textile chain, the bigger part of still reactive groups of cross-linkers complete their reactions as expected, which is the reason why afterwards no (or hardly any) pH changing capability exists, which would necessitate buffering as according to the invention.

A process comprising the step of applying a substance buffering in the suitable range onto a cellulose fiber of the genus Lyocell serves for the production of the fiber according to the invention.

In doing so, the application of the buffering substance preferably occurs in the course of the manufacturing process for the cellulose fiber, before it is pressed into a bale. In particular, the application should occur either during or after the final wet process intended for the treatment of the fiber. Namely, if another wet step occurred after the application of the buffering substances, those substances would be washed out of the fiber.

The buffering substance may be applied to the fiber, for example, in the final process step prior to drying together with the finishing bath.

Alternatively, the buffering substance may be applied in a coating process immediately before the treatment of the fiber with the finishing bath.

Likewise, it is possible to apply the buffering substance to the fiber immediately before, during or at the end of the drying process, before the fibers are pressed into bales.

In all variants, the buffering substance may be applied in liquid form or sprayed onto the fiber as an aerosol, applied via a contact lip or admixed to the fiber in a solid state in the form of an ultra-fine powder.

When cross-linking agents of formula (I) were used, the addition of alkaline buffer systems such as borax e.g. to the finishing bath had, in all cases studied, a distinctive stabilizing effect on the cross-linking of the Lyocell fibers. It may be assumed that the addition of borax to the finishing approximately doubles the period in which the cross-linked Lyocell fiber may be used without limitations to the protection from fibrillation in comparison to a non-buffered fiber, depending on the amount and the content of a partially reacted cross-linker. Quality consistency in cross-linked Lyocell fibers can thereby be ensured over a substantially longer period of time.

EXAMPLES

Measuring Methods:

Measuring Method for Determining the pH Value of Fibers:

In this method, the fibers are treated with demineralized (VE) water. Subsequently, the pH value of the water is measured.

3 g (+/−0.01 g) dry (air-dry) fibers are weighed into a 100 ml sample jar on the chemical balance. The fibers are then mixed with 30 ml VE water and treated at room temperature for one hour, with thorough shaking approx. every 15 minutes. Subsequently, the fiber is separated from the extract by means of a glass rod, and the pH value of the extract is determined with a pH meter (Messrs. Knick).

Determining the stability behaviour of the protection from fibrillation during storage, the pH dependent sensibility of the cross-linker bond as well as the pH range suitable for the long-term stability of the cross-linker bond (criteria a) and b1) to b3)):

Principle:

Buffer solutions with a concentration of the buffering substances of at least 0.1 mol/l and a pKa of the buffer system which should not deviate from the adjusted pH value by more than 0.8 pH units are produced from buffer systems known to a person skilled in the art (e.g., acetate, citrate, phosphate, bicarbonate, carbonate, borax) in a pH range from 4.0 to 10.0 in gradations of 0.5 pH units.

Variant 1) Soaked in the Liquor

At first, the protection from fibrillation of the starting fiber treated with the cross-linking agent to be examined is determined on the basis of the wet abrasion resistance (test according to WO 99/19555) in at least 3 parallel determinations. The value of the wet abrasion resistance ("NSF") is indicated in x U/dtex (revolutions/dtex), wherein x should exhibit a value >450 for a good protection from fibrillation.

Thereupon, fibers are placed into each of the above-mentioned buffer systems in the pH range from 4.0 to 10.0 at a liquor ratio of 1:10 and are kept at 50° C. in said liquid in a closed vessel.

A fiber sample is taken from each of the buffer vessels in 2-day intervals over a period of 25 days. Those samples are washed free from the buffer solution with VE water, dried carefully at 60° C. for 5 hours in the laboratory drier, and the NSF is determined.

At the end of 25 days of storage, the obtained values of NSF are plotted against time for each buffer system.

If at least one of the groups of curves thus obtained shows a clear downward trend with a loss in the abrasion value of at least 30% from beginning to end, criterion a) has been met, i.e., this is a cross-linking system sensitive to hydrolysis.

When the existence of criterion a) has been determined, the inclinations of the curves at different pH values and, in particular, the duration until a 30% reduction in the NSF is reached are compared. The "optimum value" is the pH value at which the duration until a 30% reduction in the NSF is reached, compared to the initial value, is longest (criterion b1)). The range around the "optimum value" at which the duration until a 30% reduction in the NSF is reached has been shortened by less than 20% in comparison to the maximum duration is the "suitable range" (criterion b2)) within which the fiber should be buffered according to the invention. The pH value at which the duration until a 30% reduction is reached has been shortened to 80% in comparison to the maximum duration is referred to as the "limiting value" (criterion b3)).

Variant 2) by Impregnating the Fibers with Buffers, Subsequently Drying them and Storing them Under Warm and Moist Climatic Conditions The process is similar to variant 1, except that in this case the starting fiber treated with a cross-linking agent is, in each case, impregnated in a buffer system, which should likewise contain about 0.1 mol/l of the respective buffer, in the pH range from 4.0 to 10.0 with gradations of the pH value in steps of 0.5 pH units, after the original NSF has been determined. It is made sure by subsequent squeezing or centrifuging that all fibers treated in this way have an equally high liquor pick-up. Subsequently, the fibers are carefully dried in a laboratory drier (60° C., 5 hours).

The hydrolysis stability of the cross-linking agent can now be determined as follows:

2.1) At a Temperature of 40° C. and a Relative Air Humidity of 85%:

For this purpose, the storage test must be performed for 12 weeks. Once per week, a determination of the NSF is to be conducted. (It may be assumed that, under those climatic conditions, the change in the protection from fibrillation proceeds virtually 10 times faster than if a bale with an average humidity is stored at 25° C.)

2.2) Quick Test at 50° C. and a Relative Air Humidity of 100%:

In this case, a hermetically sealable vessel the bottom space of which is filled with demineralized water is used as the system, with the fibers being positioned at some distance above the liquid. Care should be taken that the fibers do not contact walls or the like in order to prevent condensation phenomena. Just like system 1), the quick test is completed after 25 days, with a determination of the NSF being performed every $2^{nd}$ day.

The Evaluation Occurs Analogously to Variant 1).

The "limiting value" is again determined to be the pH value at which the duration until a 30% reduction is reached has been shortened to 80% in comparison to the maximum duration.

Criterion c)—Determining a pH Changing Capability

According to the invention, a cross-linking agent is kept in its suitable pH range by the use of buffering substances, if it still comprises reactive groups in the fiber or in an article containing the fiber, respectively, such as in bales, yarns and textile grey goods, which reactive groups are capable of changing the fiber pH value during the storage and/or typical moist and/or thermal treatment processes of yarns/textile assemblies in such a way that the suitable pH range is left without buffering.

The following procedure is taken for determining such a pH changing capability:

1) Determining the fiber pH value of the fiber treated with the cross-linking agent—in the following, referred to as the "starting fiber" (The fiber may be present also in the form of a yarn or a textile grey cloth). See, in this connection, the above-described measuring method.

2) Removing water-soluble substances (salts, buffers, finishings) by washing the starting fiber 10 times with demineralized water at a liquor ratio of at least 1:10 at room temperature and careful drying (60° C., 5 h). In the following, the fiber obtained by washing is referred to as a "washed fiber".

By removing the water-soluble substances, a falsification of the following test by those substances, which themselves might influence the pH value, is avoided. Since vice versa, however, consecutive reactions of the cross-linker may already be caused by washing and drying the fiber, it is necessary to examine also the (unwashed) starting fiber.

3) Establishing the fiber pH of the washed fiber

4) Storage stability test of both the starting fiber and the washed fiber according to variants 2.1 or 2.2 described above for criteria a) and b) (but without previous application of buffers), whereby the change over time in the NSF is determined 5) Checking the fiber pH value after storage both in the starting fiber and in the washed fiber: If the fiber pH value has changed in at least one of the two types by at least 1 pH unit in comparison to the initial fiber pH (in particular in a direction away from the suitable pH range determined with regard to criteria a) and b)), a cross-linking agent is present which has the capability to change the pH during the storage period.

If all criteria a) to c) have been met, i.e., if a pH dependent decrease in the protection from fibrillation during the storage period as well as a change in the pH value in the starting fiber or washed fiber toward a lower stability of the cross-linker have been detected, a cross-linker system exists which, according to the invention, can be stabilized by the application of buffers.

General proof for the application of buffer systems in a cross-linked fiber which exhibits the above-mentioned properties, and determination of the buffer capacity, respectively:

When the suitable range of a certain cross-linking agent has been determined, the following procedure can be taken for proving the stabilization by buffer systems and the determination of the buffer capacity of the fiber, respectively:

i) The detection of acid-buffering substances is necessary if a "limiting value" above a pH value of 4.0 has been determined in the above-described process and a sensibility toward acidic pH values has been determined (meaning that the storage stability deteriorates toward pH values below the limiting value).

Detection of Acid-buffering Substances:

Fibers (optionally in the form of yarns or textile grey goods) are extracted with demineralized water at room temperature for one hour at a liquor ratio of precisely 1:10. The fibers and the extract are separated, and an aliquot of exactly 50 ml of said extract is at first titrated with 0.01 mol/l HCl to a pH value which is exactly 1.50 units below the previously determined "limiting value". Thereupon, the solution is titrated with 0.01 mol/l NaOH back to a pH value which is exactly 1.50 pH units above the "limiting value". The consumption of 0.01 mol/l NaOH within those 3.00 pH units is read from the titration curve. 5 ml thereby corresponds to a buffer capacity of 10 mmol/kg fiber.

ii) The detection of alkali-buffering substances is necessary if a "limiting value" below a pH value of 10.0 has been determined in the above-described process and a sensibility toward alkaline pH values has been determined (meaning that the storage stability deteriorates toward pH values above the limiting value).

Detection of Alkali-buffering Substances

Fibers (yarns, grey goods) are extracted with demineralized water at room temperature for one hour at a liquor ratio of precisely 1:10. The fibers and the extract are separated, and an aliquot of exactly 50 ml of said extract is at first titrated with 0.01 mol/l NaOH to a pH value which is exactly 1.50 units above the previously determined "limiting value". Thereupon, the solution is titrated with 0.01 mol/l HCl back to a pH value which is exactly 1.50 pH units below the limiting value. The consumption of 0.01 mol/l HCl within those 3.00 pH units is read from the titration curve. 5 ml thereby corresponds to a buffer capacity of 10 mmol/kg fiber.

Exemplary Embodiments

Example 1

Lyocell fibers which have been produced according to the prior art and have been cross-linked with a cross-linker of the above formula (I) (sodium salt of 2,4-dichloro-6-hydroxy-1.3.5-triazine) in each case in the same manner were treated as follows:

Example 1a) (according to the invention)—treatment with borax (0.6% on fiber), pH value of the fiber=9.2

Example 1b) (according to the invention)—treatment with carbonate buffer ($Na_2CO_3$/$NaHCO_3$, molar ratio 1:1; 0.2% on fiber), pH value of the fiber=10.2

Example 1c) (comparative example)—no treatment, pH value of the fiber=8.5

Example 1d) (comparative example)—treatment with a weakly acidic fiber finisher, pH value of the fiber=6.7

The wet abrasion resistance (NSF) of the fibers was measured according to the process described, for example, in WO 99/19555. Subsequently, the fibers were stored under identical conditions in an extreme climate of high air humidity and temperature. The so-called "half-life" was determined, which is the time in which the NSF has dropped down to half of the original value:

Example 1a) (borax): approx. 11 weeks

Example 1b) (carbonate): 10 weeks

Example 1c) (no buffer): approx. 7 weeks

Example 1d) (acidic finisher): 3 weeks.

In addition, no decrease in the NSF was observed in the fibers according to Examples 1) and 2) in the first weeks of storage, whereas a steady decrease in the NSF could be determined in the fibers according to Examples 3) and 4).

Example 2

With regard to the sodium salt of 2,4-dichloro-6-hydroxy-1.3.5-triazine, it was determined according to the above-described method that a "limiting value" existed at pH 8.5, below which the storage stability of the protection from fibrillation deteriorated.

Accordingly, the buffer capacity was determined in different samples of Lyocell fibers, which, in each case, had been treated with the same amount of said cross-linking agent, according to the above-described method by titrating the extract of the fiber to pH 7.0 with 0.01 mol/l HCl and titrating it back to pH 10.0 with 0.01 mol/l NaOH:

The consumption of 0.01 mol/l NaOH in the pH range from 7.0 to 10.0 was determined. The buffer capacity of the fiber can be calculated therefrom according to the following formula:

ml consumption NaOH*0.01*1000/5=mmol buffer/kg fiber

The Following Samples were Tested:

Sample 1: Fiber treated with 2 g borax/kg fiber

Sample 2: Fiber treated with 3.5 g borax/kg fiber

Sample 3: Fiber treated with 12 g borax/kg fiber

Sample 4: Fiber treated with 6 g borax/kg

Sample 5: Fiber treated with 1.5 g sodium carbonate/kg fiber

Sample 6: Fiber treated with 1 g sodium carbonate/kg fiber

Samples 7 to 11: Samples of fibers which, in each case, had not been treated with buffering substances

| Sample: | ml 0.01m NaOH between pH 7.0 and pH 10.0 | mmol buffer/kg fiber between pH 7.0 and 10.0 |
|---|---|---|
| 1 | 12.61 | 25.22 |
| 2 | 19.27 | 38.54 |
| 3 | 59.69 | 119.38 |
| 4 | 33.36 | 66.72 |
| 5 | 9.74 | 19.48 |
| 6 | 7.56 | 15.11 |
| 7 to 11 (mean value) | 3.26 ± 0.95 | 6.52 ± 1.92 |

It is obvious that in all samples containing a substance having a buffering effect in the range from 7 to 10, such as borax or carbonate, the buffer capacity (clearly) exceeds 12 mmol/kg fiber.

What is claimed is:

1. A cellulose fiber of the genus Lyocell which will be subjected to wet processing which is treated with a cross-linking agent, with the cross-linking agent inducing a protection from fibrillation on the fiber and exhibiting the following properties:

the protection from fibrillation induced by the cross-linking agent changes if the fiber is stored within a pH range from about 4.0 to about 10.0;

within the pH range from about 4.0 to about 10.0, an optimum value exists at which the stability of the protection from fibrillation induced by the cross-linking agent during storage, before being subjected to said wet processing, is highest;

a suitable range exists around the optimum value in which the stability is reduced by 20% at the most, compared to the stability at the optimum value;

within the pH range from about 4.0 to about 10.0, the suitable range is limited by at least one limiting value at which the stability is reduced by 20% compared to the long-term stability at the optimum value and with a further decrease in stability occurring below and above said value, respectively;

the cross-linking agent has the capability to change the pH value, wherein the fiber contains at least one buffering substance buffering in the suitable range and exhibits a buffer capacity of at least about 12 mmol/kg fiber in the suitable range; and wherein the at least one buffering substance maintains the pH of the fiber in the suitable range during storage, before being subjected to said wet processing.

2. The cellulose fiber according to claim 1, wherein the at least one buffering substance has a $pK_a$ value in the suitable range or outside of the suitable range by up to 1 pH unit.

3. The cellulose fiber according to claim 1, wherein the cross-linking agent is a substance of formula (I)

(I)

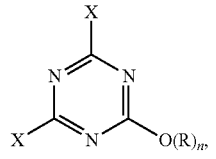

wherein X represents halogen, R=H or an ionic moiety and n=0 or 1, or a salt of said compound, respectively.

4. The cellulose fiber according to claim 3, wherein the fiber exhibits a pH value ranging from 8.5 to 10.5.

5. The cellulose fiber according to claim 3 or 4, wherein the at least one buffering substance has a $pK_a$ value ranging from 8.0 to 11.0.

6. The cellulose fiber according to claim 3 or 4, wherein the buffering substance is selected from the group consisting of borax; carbonates or bicarbonates of alkali metal ions, ammonium or cations derived from substituted amines; phosphates, hydrogen phosphates or dihydrogen phosphates of alkali metal ions, ammonium or cations derived from substituted amines; ammonia; substituted amines; guanidine or guanidinium salts; and mixtures thereof as well as mixtures with carboxylic acids and salts thereof.

7. The cellulose fiber according to claim 6, wherein the buffering substance comprises borax in concentrations of at least 1525 mg borax per kg fiber.

8. The cellulose fiber according to claim 7, wherein the buffering substance comprises borax in concentrations from 2860 mg to 14000 mg borax per kg fiber.

9. The cellulose fiber according to claim 6, wherein the buffering substance comprises the buffer system sodium hydrogen carbonate/sodium carbonate in concentrations of at least 848 mg per kg fiber (calculated as sodium carbonate).

10. The cellulose fiber according to claim 9, wherein the buffering substance comprises the buffer system sodium hydrogen carbonate/sodium carbonate in concentrations from 1580 mg to 7420 mg per kg fiber (calculated as sodium carbonate).

11. The cellulose fiber according to claim 1, wherein the fiber exhibits a fiber moisture of 8-10%.

12. A bale of cellulose fibers, comprising cellulose fibers according to claim 1.

13. A yarn, woven fabrics, knitted fabrics, braided fabrics and hosieries, comprising cellulose fibers according to claim 1.

14. A process for the production of a cellulose fiber according to claim 1, comprising the step of applying a buffering substance in the suitable pH range onto a cellulose fiber of the genus Lyocell.

15. The process according to claim 14, wherein the application of the buffering substance occurs in the course of the manufacturing process for the cellulose fiber, before it is pressed into a bale.

16. The cellulose fiber according to claim 1, wherein the fiber contains a buffering substance in the suitable range and exhibits a buffer capacity of from about 15 to about 70 mmol/kg fiber in the suitable range.

17. The cellulose fiber according to claim 3, wherein the cross-linking agent is the sodium salt of 2,4-dichloro-6-hydroxy-1.3.5-triazine.

* * * * *